United States Patent [19]

Kraiss

[11] Patent Number: 4,610,422

[45] Date of Patent: Sep. 9, 1986

[54] MOULDING APPARATUS FOR SHAPING CONCRETE PARTS

[75] Inventor: Richard Kraiss, Laichingen-Suppingen, Fed. Rep. of Germany

[73] Assignee: Georg Prinzing GmbH & Co. KG Betonformen- Und Maschinenfabrik, Blaubeuren, Fed. Rep. of Germany

[21] Appl. No.: 694,640

[22] Filed: Jan. 24, 1985

[30] Foreign Application Priority Data

Feb. 8, 1984 [DE] Fed. Rep. of Germany ..... 3404287
Jun. 22, 1984 [DE] Fed. Rep. of Germany ..... 3422981

[51] Int. Cl.[4] ..... B28B 7/30

[52] U.S. Cl. ..... 249/94; 249/10; 249/102; 249/152; 249/178; 249/184; 249/194; 425/441

[58] Field of Search ..... 249/10, 11, 63, 93, 249/94, 97, 102, 151, 152, 178, 180, 184, 193, 194; 425/438, 441, 443

[56] References Cited

U.S. PATENT DOCUMENTS 1,112,034 9/1914 Ross ..... 249/178
3,762,678 10/1973 Thornton ..... 249/193

FOREIGN PATENT DOCUMENTS 712969 7/1965 Canada ..... 249/97
3110185 9/1982 Fed. Rep. of Germany ..... 249/94

*Primary Examiner*—Jay H. Woo
*Assistant Examiner*—James C. Housel
*Attorney, Agent, or Firm*—Michael J. Striker

[57] ABSTRACT

A mould arrangement for shaft rings or the like in which the hat-shaped mould core comprises a core segment consisting of a cover portion with, adjacent thereto, a wall portion which is adapted for displacement horizontally into a closed position completing the shaped contours of the mould core and inwardly into a release position for removal of the form work. The mould core has a fit-in device for the cementing in of projecting elements, above all climbing irons, from the interior into the concrete part which is to be formed and during the shaping process. In addition to the core segment, the fitting-in device has for each climbing iron a housing, a clamping device associated therewith, and a clamping drive common to all these. Together with these parts, the core segment is detachably and exchangeably so mounted on the remainder of the mould core that it can be coupled to or uncoupled from the horizontal translatory drive. Thus, while retaining the rest of the mould core, the core segment can be exchanged for a different one. As a result the investment costs for individual mould cores are substantially reduced.

38 Claims, 11 Drawing Figures

MOULDING APPARATUS FOR SHAPING CONCRETE PARTS

BACKGROUND OF THE INVENTION

The invention relates to a moulding apparatus for shaping concrete parts, e.g. shaft rings, shaft necks or the like, provided with preferably a plurality of projecting elements, in particular climbing elements, such as climbing irons, stirrups or the like.

A known moulding apparatus of this type (German Patent No. 31 10 185) has proved very successful. In particular, this applies to the moulding apparatus shown in FIG. 1 and described in the associated text, wherein the core segment has a plurality of apertures for the insertion of climbing elements from outside, i.e. from the moulding space, and furthermore, for each climbing element, a housing, a clamping device associated therewith, and a clamping drive common to all clamping devices. Thus designed, the core segment is for instance already in the closed position for the insertion of the climbing elements, the climbing elements being inserted from outside the moulding core through the apertures and into the associated housings, after which they are held firmly on the core segment by actuation of the common drive and all clamping devices. For removal of the form work from a concrete part, wherein during the forming process, in the manner described, the climbing elements are cemented into place at the same time, actuation of the clamping drive releases the individual clamping devices from their relevant associated housing and the climbing element located therein. Afterwards, the core segment is moved out of the closed position in which it completes the shaped contours of the moulding core, inwardly into the moulding core by horizontal movement by means of the drive device, being thus moved into a release position, resulting in the climbing elements which project into the interior of the moulding core being freed after which the concrete part may have the form work removed from it by relative movement between concrete part and moulding core, without the cemented-in climbing elements sticking anywhere and being torn out. The term 'climbing elements' embraces every possible form and construction of climbing elements which satisfy the function of steps or treads and make it possible to negotiate a shaft composed, for instance, of individual shaft rings. Thus, climbing elements may, for example, be climbing irons or also stirrups with a downwards cranking, which thus at the same time guarantees lateral guidance and a safeguard against slipping. The term also embraces other kinds of climbing elements.

In practice, variously designed climbing elements are cemented into concrete parts, e.g. shaft rings, shaft necks or like shaft parts, in fact for instance on the one hand the long since conventionally employed standard climbing iron made from cast iron and a substantially heavier and larger safety climbing iron, similarly of cast iron, which by virtue of its special shaping, is said to offer the foot a more reliable grip. Furthermore, the differently designed climbing elements which may be used are the already described stirrups. Furthermore, concrete parts, e.g. shaft rings, shaft necks and like shaft parts, have to be produced in cement works even without any climbing elements or like transversely projecting elements. This multiplicity of production tasks has in the past made it necessary to keep available and in stock specially adapted mould cores to suit each particular job. Since the concrete parts, particularly shaft rings, shaft necks or the like, which have to be produced also have to be made in various sizes and heights, this fact must also be taken into account by stocking correspondingly adapted mould cores. In this way, a large number of differently constructed mould cores and component parts have to be kept in stock, which is disadvantageous not only by virtue of the considerable space and cost involved but which above all necessitates considerable investment.

For example, even if variously dimensioned and shaped climbing elements were to be provided for by particular inserts mounted on the core segment according to the job involved, then this would have the considerable disadvantage that a plurality of individual special inserts would have to be purchased, stocked and maintained, which would similarly necessitate substantial expense. Furthermore, the conversion time would be extremely time-consuming and, being labor-intensive, expensive. This also applies to any inserts designed to allow a moulding core intended for the direct cementing-in of climbing elements to be used instead for the manufacture of concrete parts, particulary shaft rings, shaft necks or the like which do not require such climbing elements. Inserts which might possibly be used would be, for instance, facings, which would entail the same disadvantages as previously described.

For the rest, the moulding equipment intended, for instance, for the direct cementing-in of downwardly cranked stirrups is in design different from the equipment intended for the direct cementing-in of other climbing elements, e.g. standard climbing irons or heavier and larger safety climbing irons. For instance, in the case of a core segment for the direct incorporation of downwardly cranked stirrups, for example the clamping devices associated with each housing are positioned at a distance below the housing. The clamping direction is from the bottom upwardly while release of the stirrups, on the other hand, occurs from the top downwardly, in order to overcome the downwards cranking of the stirrups. With such core segments as are intended for the direct cementing-in of climbing irons which are not downwardly cranked, locking of the individual clamping devices takes place from the top downwardly while releasing occurs in the opposite direction, upwardly. Conversion of a mould core by changing purely inserts for the different forms of climbing elements will therefore not be sufficient. From the point of view of the different type of operation, for instance a mould core designed for the direct cementing-in of downwardly cranked stirrups cannot be converted to the other type purely by exchanging the inserts, housings and supporting means.

SUMMARY OF THE INVENTION

An object of the invention is to provide a moulding device which, while economizing on investment costs for differently designed and constructed mould cores, reduces the number of different mould cores and mould core parts for the production of concrete parts having different types of projecting elements, particularly climbing elements.

According to the invention there is provided a moulding apparatus for shaping concrete parts comprising a substantially hat-shaped moulding core with for instance a cylindrical core wall and a top cover, the moulding core comprising a fitting-in device so that during the shaping process, projecting elements can be cemented from the inside into the concrete part which is to be formed, the fitting-in device comprising at least one core segment forming at least one wall portion of the core wall and adapted to be moved by a drive device in relation to the rest of the mould core out of the shaped contour and into a release position which permits the form work to be removed from the concrete part with its cemented-in elements, and back into a closed position in which the core segment fits into the rest of the mould core, completing its shaped contours, and which furthermore for each element, which is to be cemented in, has a housing and associated therewith a clamping device with clamping drive, the improvement being that the core segment together with the respective housings and the associated clamping devices and clamping drive are detachably and exchangeably supported on the rest of the mould core. In consequence, a substantial cost saving is achieved because only one mould core and, in addition, for each type of projecting element, particularly climbing element, which has to be cemented in directly during manufacture of the concrete part, and for manufacture of a concrete part without such projecting elements, only one core segment specially designed for the purpose will be required. Therefore, the rest of the mould core, apart from the core segment, can always be used again. Adapting to the relevant production problem, only one specially adapted core segment is required and used. Thus, the number of individual elements which require to be stocked, maintained and cleaned again after use will be substantially reduced. This leads not only to a saving on space and economy on space costs, but in particular to a reduction in investment costs. It is also possible to be very flexible and to change over quickly from one type of production to the other. Changing just the core segment can be carried out quickly and easily. A further substantial advantage resides in the fact that a used core segment can be quickly and easily withdrawn for servicing and cleaning, and jobs can also be carried out quickly and without problem at places which it would otherwise be difficult to reach or which could be performed only with considerable difficulty and while working in a constrained attitude. At the same time, it is advantageous that by withdrawing the core segment, the interior of the mould core becomes accessible from above, it is therefore possible also to clean, repair or service the mould core quickly and easily even without having to perform these tasks from below, at considerable expense and possible in an awkward position.

A further advantage achieved when the core segment is formed so that it can be detachably coupled to and uncoupled from the drive device. This provides for particularly rapid exchange of the core segment without this having to be fixed particularly on the drive device located in the rest of the mould core, for example by screws of other time-consuming operations.

According to a further embodiment a particularly rapid and easy exchange of the core segment is achieved. In this embodiment the core segment is disposed to be pushable into the remaining wall portions of the mould core wall from above and withdrawn in the opposite direction, without any other screwed connection, clamped joint or the like being necessary. Nevertheless it is ensured that upon insertion of the core segment, coupling to the drive device occurs automatically, bringing about horizontal movement between the release position and the closed position and also, in the closed position, the application of pressure to seal the gap.

According to a further advantageous embodiment guide members and guides are located on and extending from the one wall portion and the remaining wall portion in the region of mutually adjacent lateral edges of the one wall and remaining wall portion, the guide members and guides automatically entering into a guiding engagement with one another upon insertion of the core segment. In this way, vertical guide systems effective on both edges of the wall portion of the core segment are provided that maintain the core segment in the desired direction when it is being pushed into place. Furthermore, the guide systems result in a strengthening of the edges.

In yet further advantageous embodiments rails are fixed on each lateral edge of the one wall portion, each rail having a laterally projecting bearing and sealing surface extending as a continuation of an inner face, so that when the core segment is inserted, the lateral edges of the one wall portion bear against the lateral edges of the remaining wall portion and seal any gaps. The rails can also be constructed is strips for reinforcing the one wall portion and thus the entire core segment is strengthened and stiffened. In consequence, and due to the application of pressure by the core segment in the closed position, it is guaranteed that during the shaping process, vibrating produces a rigid joint between the inserted core segment on the one hand and the rest of the mould core on the other, ensuring satisfactory transmission of the vibrations from mould core to the core segment. Consequently, by reason of the pressure applied by the core segment, this and the rest of the mould core are connected to become virtually one vibration unit, rigid in itself. Furthermore, the strips with a bearing and sealing surface around the edge of the wall portion of the core segment ensure a good seal from the bottom upwards, so that concrete, particularly cement mortar, from the mould space cannot pass through gaps and reach the interior of the mould core. If necessary, also the bottom edge of the wall portion of the core segment can be provided with a corresponding strip which follows the shape, e.g. curvature, of the wall portion and which is likewise provided with a bearing and sealing surface and which also in this region is pressed tightly against the bottom edge of the core wall of the mould core. It will be appreciated that the cut-out in the top which is needed for horizontal movement of the core segment between the release position and the closed position is not only deep enough in this direction but also is sufficiently wide transversely thereto so that for exchange purposes, the core segment can be withdrawn upwards without difficulty and inserted in a downwards direction. The top part of the wall portion of the core segment is thereby of larger dimensions than this cut-out in the top and it lies flat around the edges of the rest of the top.

A further simplification is provided in still another embodiment, wherein each rail is formed as a part of the guide of the wall portion which is provided on each lateral edge so that the sealing and strengthening strips are at the same time used as guide parts for the vertical guide systems. A further embodiment provides for a further marginal strengthening of the wall portion and thus of the core segment by way of an angle element fixed on each rail and extending over the rail length, the angle element having one arm which extends at a distance from the rail surface so as to form a guide slot.

It will be understood that the situation may also be kinematically changed around, i.e. the guide groove may be part of the mould core while the part engaging into the guide groove may be supported on the core segment.

In a further advantageous embodiment at least one guide member associated with a lateral edge at the one wall portion is formed as a part of the drive device and is actuated thereby. This results in a simple means of providing a guide system, the individual elements of which form at the same time functional parts of the drive device and serve for marginal reinforcement of the wall portion of the core segment.

In yet a further advantageous embodiment, at least one pivot lever is connected to the drive device for each guide member, and a variable-length push rod is articulated on the pivot lever, the pivot lever operating as an associated guide member through the variable-length push rod. Each pivot lever with the variable length push rod articulated thereon forms a kind of elbow lever. The fact that the length of the push rod can be varied is made possible by an adjusting spindle with left and right-hand threads. The pressure applied by the core segment on the core wall can by this means be ver accurately adjusted. Furthermore, in the event of any wear or like, there is a possibility of readjustment. The elbow lever system has the advantage that vibrations can be satisfactorily transmitted through it to the core segment and above all forcing back of the core segment under the effect of the pressure of the concrete is avoided in that the elbow lever arrangement absorbs this pressure. The drive device is therefore relieved of these forces. The push rod can be so adjusted in length that the pivot lever with push rod assumes its dead center position when the core segment, in the shaping position, is being pressed against the core wall of the mould core and is to be held in that position. Parallel guiding of the core segment via the elbow lever arrangement is achieved by an additional embodiment having a shaft mounted on the core wall and the pivot levers being connected to the shaft for joint rotation therewith.

Another advantageous embodiment ensures that upon displacement of the core segment into the release position or into the closed position, parallel displacement of the core segment is guaranteed even without any special parallel guidance for the core segment. As a result of a relevant flow divider in the line leading to the hydraulic or pneumatic working cylinders, in fact prior to distribution to the two working cylinders, the flow of pressurized working medium is divided into two equal flows which are then fed to the two working cylinders, so that they compensate each other and move in parallel.

According to the design of the control system, so also for the opposite driving movement, the pressurized working medium is adapted to be fed firstly to a flow divider and only then are equal partial flows fed to the working cylinders through individual lines. It will also be understood that also a single flow divider may be adequate for operation in one working direction. In the case of movement back in the opposite direction, then, this flow divider ensures that the two reverse flows from the working cylinders are also of equal magnitude and then combine after the flow divider to form one overall flow.

According to the features of yet another embodiment, two working cylinders are used in said drive device, the cylinders being formed so as to generate a pressure force which ensures that during the shaping precess, the pressure of concrete acting from within the mould space and on the wall portion of the core segment cannot force the core segment out of the closed position and in the direction of the release position.

A further advantageous embodiment has a guide on the mould core, each guide member which is supported on the remaining wall portion of the mould core being part of an associated positioning element. Here, the positioning element carries the associated guide member and is separately guided independently of the associated translatory drive in the direction substantially parallel with the translatory direction. These separate guides and positioning elements certainly require additional parts which are subject to wear and tear in the long term and which furthermore require maintenance.

Instead, it may be of particular advantage to arrive at a design of a still further embodiment in which each translatory drive has a moving part and another part, each guide member being rigidly attached to the moving part of a respective translatory drive and being guided along with the moving part on another part of the respective translatory drive, the other part being rigidly mounted on said mould core. This ensures direct guidance by the relevant translatory drive, particularly the working cylinder. In the case of a working cylinder, guidance is brought about directly by the adjacently guided parts of the working cylinder, namely piston rod on the one hand and cylinder barrel on the other. Thus, the number of necessary parts is reduced, which saves expense. Of particular advantage above all is fact that a completely maintenance-free guidance is provided. At the same time, wear and tear is very small since with such working cylinders the piston rod is hard-chromed and thus highly resistant to wear. For the rest, special piston rod guidance of an over-dimensioned construction should be chosen, with a particularly good sealing of the piston rod and dirt scrapers which provide for lengthy durability. It will be appreciated that the cross-section of the piston rod can be so dimensioned that it has the necessary flexural strength. In order to ensure the necessary closure pressure and the necessary abutment force, it is possible also for the pressure of the working cylinder to be suitably adapted. In another embodiment each translatory drive is working cylinder having a cylinder housing and a moving piston rod and the cylinder housing is fixed on the rest of the mould core while the piston rod of the working cylinder is moved together with the guide member which is rigid thereon. The position is reversed in another embodiment in which the continuous piston rod is fixed at both ends to the rest of the mould core while the cylinder housing of the working cylinder is adapted for displacement in relation to the piston rod, movement occurring on the piston rod and together with the guide member which is rigid thereon. In this case, the piston is disposed in the middle of the piston rod. Advantageous here is that during the forwards and backwards motion of the cylinder barrel, identical piston faces are in each case created. Furthermore, very accurate guidance is achieved since the cylinder barrel has guides at both end zones, with a relatively large axial guidance gap. Also any flexural loading can be readily accommodated by the piston rod since it is connected to the rest of the mould core in the region of both its ends.

As a result of the features of another embodiment, which has a locking arrangement, the closed position of the core segment is mechanically locked by the locking device so that the drive device is relieved in order to secure the closed position.

According to the features of yet another embodiment the one wall portion has a top and a cover portion fixed on the top, and the top cover of the mould core has a cut-out which is overlapped by the cover portion of the one wall portion in a sealing-tight manner. On the one hand an easy changing of the core segment in ensured while on the other hand is guaranteed that the top of the mould core is tightly closed so that no cement or the like can pass through gaps and into the interior of the mould core.

In a further advantageous embodiments the cover portion is either welded on to the one wall portion or is an integral part of the core segment. This results in a further stiffening of the core segment, particularly of the wall portion. Even though parallel guidance of the core segment in relation to the mould core is not possible, such parallel guidance is indeed guaranteed, by the provision of at least one flow divider in the supply line to the two working cylinders.

Instead of this, another embodiment is also advantageous. This embodiment has a cover guide on the remaining wall portion of the mould core, the cover guide extending at least substantially at a right angle to the central axis of the mould core, the cover portion being guided for reciprocating displacement along the cover guide and supported thereon, and the cover portion being detachably connected to the one wall portion. For exchanging the core segment, the cover part has to be detached from the wall portion and moved sufficiently in the direction of the release position to allow withdrawal of the core segment.

In additional embodiments the top cover is fixed to, welded to or an integral part of the remaining wall portion. This achieves a substantial stabilizing of the mould core, above all of the rest of the core wall, which is thus strengthened additionally against independent opening or against compression.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

FIGS. 1 to 5 diagrammatically show a mould core 15 of moulding apparatus and component part of a machine not shown in greater detail. The moulding equipment serves for the shaping of concrete parts, particularly shaft rings, shaft necks, concrete cylinders, transition rings or the like. Details of such moulding equipment are described in particular in German Patent No. 31 10 185, to which reference is expressly made in order to avoid unnecessary repetitions. The same applies to the manner of functioning and the procedural programme involved in shaping.

The mould core 15 is so designed that during shaping of the concrete part, preferably a plurality of projecting elements of any desired kind, in the present example climbing irons, can be cemented into the concrete part from within. The term 'climbing iron' used here embraces all conceivable types and constructions of such elements, which fulfill the function of steps and which make it possible to negotiate a shaft which is composed of such shaft rings. The term climbing iron thereby covers the normal climbing irons which are usually so designated and also the heavier and larger safety climbing irons, e.g. those made from cast iron, as well as the climbing elements usually termed as stirrups. Also in this respect, reference is made to German Patent Specification 31 10 185. Climbing irons of the said type are not shown in greater detail in FIGS. 1 to 5.

Figure 1:
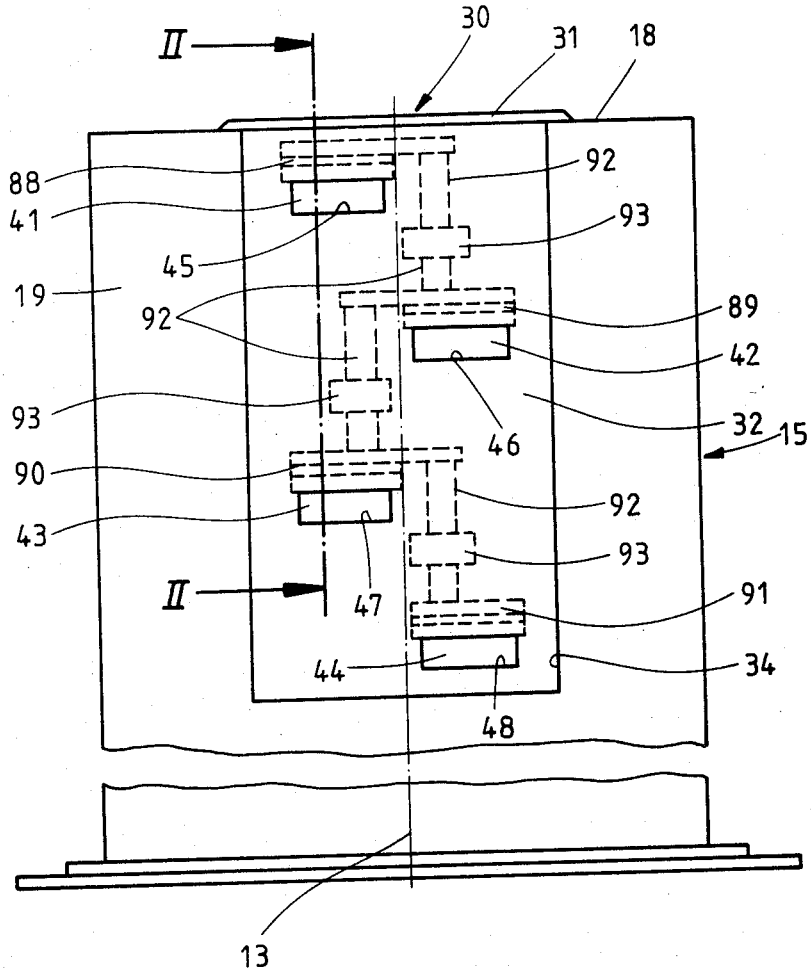
FIG. 1 shows a diagrammatic side view of the mould core of moulding equipment for shaping concrete parts, according to a first embodiment.
Figure 1A:
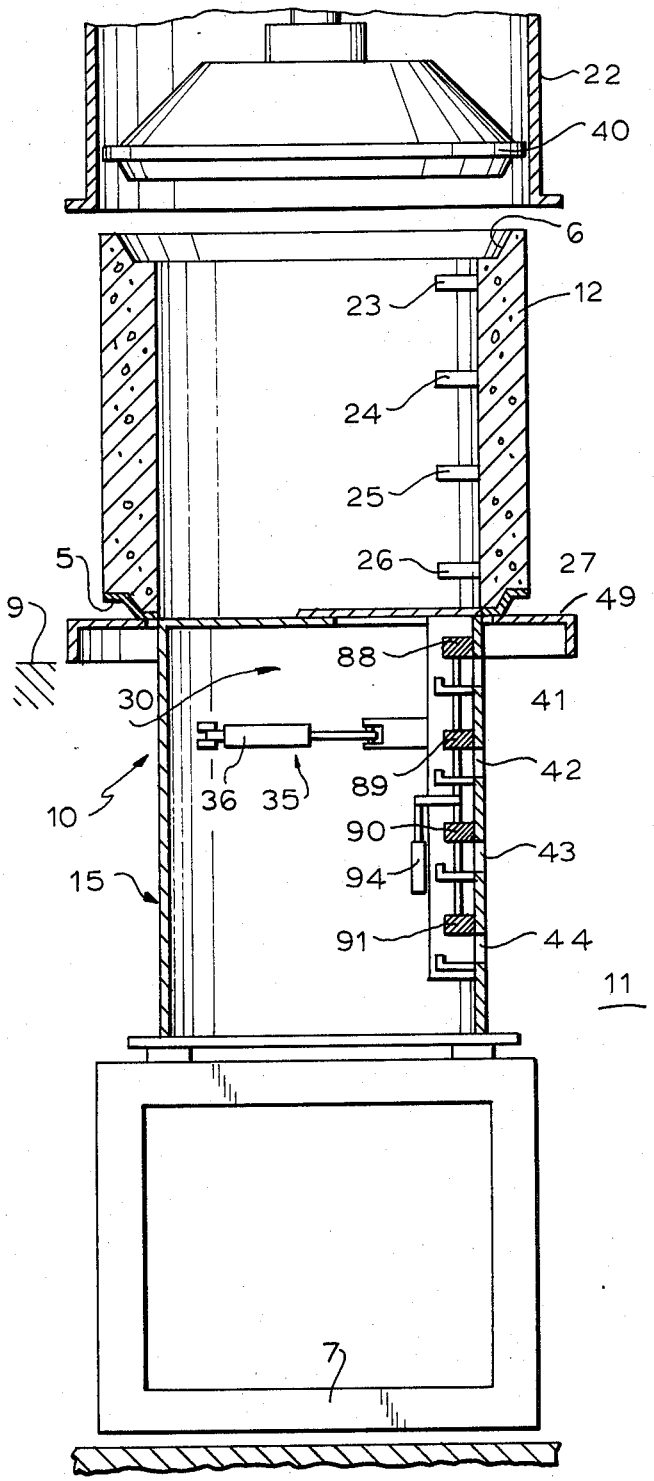
FIG. 1*a* is a diagrammatic longitudinal section through a part of a machine with the moulding equipment and molding core in a position after finishing the automatic operating cycle, whereby a core segment is in its closing position ready for receiving of climbing element to be inserted, after opening a mold of a finished concrete part.

As shown in FIG. 1*a*, the molding equipment is part of an underground machine 10 which is indicated only schematically. The underground machine 10 has an operating area 11 below the ground level 9 in which a bottom sturdy support 7 is disposed. By means of the underground machine 10 the concrete parts which are schematically indicated bearing the reference numeral 12, in particular pit rings, pit necks, well rings, transmission rings or the like, can be formed. The concrete part 12 consists of a cylindrical ring wall element, whose lower and upper front face is provided with folds 5 and 6 for a forcelocking of interlocking concrete parts 12, which are also formed in the same manner as the cylinder form in the molding equipment.

Simultaneously, during the molding operation four climbing irons 23 to 26 have been inserted from the inside in the concrete part, for example, which are offset with respect to each other like stairs and which have the function of steps thus permitting the walking of a pit which is composed of a plurality of concrete parts 12.

In addition to the mould core 15, which is detachably mounted on the support 7, an outer mould 22 as well as an upper sleeve 40 and a lower sleeve 40 are provided which is supported on an output plate 49.

For making a concrete part 12, the output plate 49 is moved downwardly into the operating area 11 while being supported on the lower sleeve 27, after removing the illustrated concrete part 11 and a new lower sleeve 27 is inserted which then support on the lower side of the output plate 49. Thereafter, the mould jacket 22 is moved downwardly by the machine until it engages on the lower sleeve 27, if its diameter is larger, or on the output plate 49. Thereafter, reinforcement rings are inserted into the hollow molding chamber in a customary manner, which is not described in detail. Also, the aforementioned inserting of climbing irons into the mould core is not described here. This will be described later.

The mould core 15 is substantially hat-shaped It is hollow in its interior and is exchangeably mounted one central vibrator 14. The central vibrator 14 is mounted on a base-plate 16. In its interior, the mould core 15 comprises for example a welded-in plate 17 by which it is placed and fixed on the central vibrator 14. The plate 17 is, for example, shaped like three-quarters of a circle. The could core 15 is in this case, for example, circular but in another embodiment not shown it may instead be non-circular, e.g. oval, rectangular or the like. The mould core 15 comprises a circular cover 18 and a cylindrical core wall 19 leading downwardly to the baseplate 16.

For filling a hollow moulding chamber with concrete, a charging device, not shown, is moved by the machine into the area of the moulding equipment and fills concrete from above into the hollow moulding chamber. When the mould is field, the central vibrator 14 is activated so that the concrete is compressed. Simultaneously, concrete is constantly afterfilled from above. The central vibrator 14 is slowed down after a predetermined time. Simultaneously, the charging device not illustrated, moves back from the moulding equipment, whereby excess concrete is simultaneously removed in the area of the cover 18 of the mould core 15. When the charging device has reached its rearmost initial position, the upper sleeve 40 moves downwardly, being controlled and driven by the machine, and is pushed from above so that the upper fold 6 is formed and the concrete is simultaneously further compressed. Thereafter, the central vibrator 14 is completely switched off.

Figure 2:
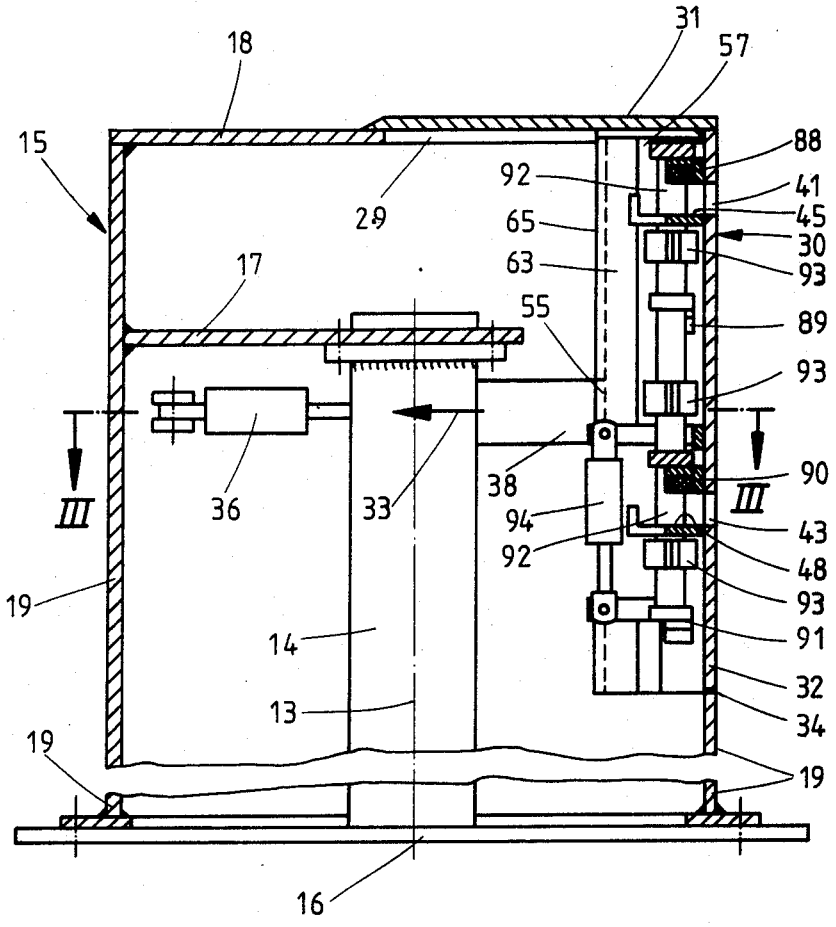
FIG. 2 is a diagrammatic longitudinal section through the mould core taken on the line II—II in FIG. 1.

The mould core 15 has a fit-in device 29 by means of which, during the shaping process, at least one climbing iron but preferably several climbing irons at the same time, e.g. four climbing irons, can be cemented from within and into the concrete part which is to be formed. The fit-in device 29 comprises a core segment 30 which is here constituted by a cover portion 31 and a wall portion of the mould core 15. The cover portion 31 is somewhat larger than the cover cut-out 28 which, in the condition of the cover portion 31 shown in FIG. 2, is overlapped in sealing-tight fashion on the three sides which substantially form a U. The rest of the cover 18 which comprises the cut-out 28 is mounted on the core wall 19, being in particular welded thereon or being instead integral therewith so that this rest of the mould core 15 is thereby strengthened and reinforced against deformation in the region or the cover 18, particularly deformation of the core wall 19.

For removing the mould after the concrete part has been formed while the concrete is not yet settled, the core segment 30 is actuated in a manner which will be described layer, so that the climbing irons 23 to 16 which were imbedded in the concrete are released and are not torn off during the removing of the mold. For removing the mould jacket 22 is moved upwardly, whereby the upper sleeve 40 still pushes from above on the concrete part 12 and forms an abutment for the same. Thereafter, the upper sleeve 40 is moved upwardly by the machine and thereafter the output plate 49 with the lower sleeve 27 resting thereon and the concrete part 12 are moved upwardly relative to the molding core 15 into the position in accordance with FIG. 1. The mould core 15 remains stationary in the underground area.

Figure 3:
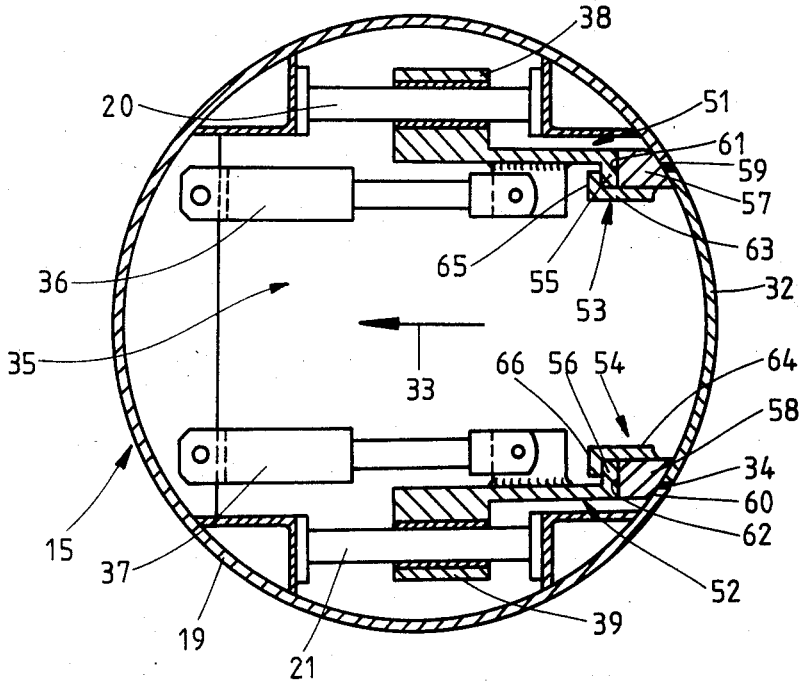
FIG. 3 is a diagrammatic cross-section through the mould core taken on the line III—III in FIG. 2.
Figure 4:
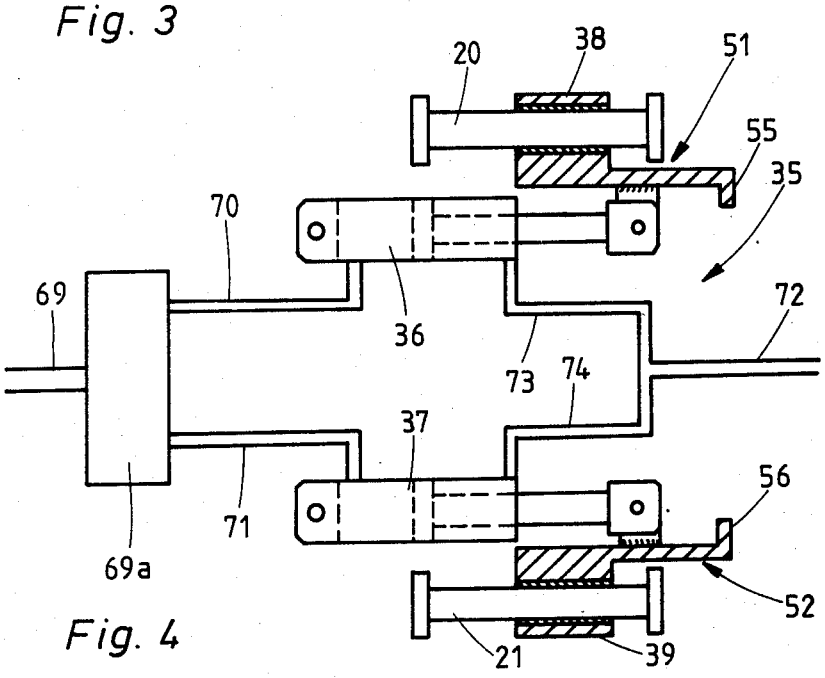
FIG. 4 is a partially sectional diagrammatic view of the drive of the mould core with pressurized medium supply.

The wall portion 32 of the core segment 30 has the form of a portion of the cylinder wall. The cylindrical core wall 19 is, in keeping with the wall portion 32, provided with an identically formed portion 34, which, in side elevation according to FIG. 1, is of substantially U-shape extending from the top downwardly. In a side view or section (FIG. 2), the core segment 30 proves to be of substantially angled shape. In comparison with the rest of the mould core 15, the core segment 30 constitutes an independent element, together with the cover portion 31, which in the case of the first embodiment according to FIGS. 1 to 5, is fixed, in particular welded, at the upper end of the wall portion 32. The core segment 30 is, in relation to the mould core 15, adapted for movement in respect of the could core 15 out of the shaped contours thereof (FIGS. 1 to 3) horizontally inwardly in the direction of the arrow 33 into a release position, not shown, and in the opposite direction to arrow 33, back into the closed position shown in FIGS. 1 to 3. If the core segment 30 is moved in the direction of the arrow 33 into the release position, then the wall portion 32 leaves the cylindrical shaped contours of the core wall 19. Furthermore, the cover portion 31 is displaced leftwardly in FIG. 2 on the rest of the cover 18. The cut-out 34 in the core wall 19 is exposed. Climbing irons moulded in situ during the shaping process are thereby freed from the core segment 30 so that removal of form work from the finished concrete part with the climbing irons incorporated at the same time therein can take place upwardly or downwardly by relative displacement between concrete part and mould core 15. In the closed position of the core segment 30 is shown in FIGS. 1 to 3, this merges substantially steplessly but above all without gaps and in sealing-tight fashion into the rest of the mould core 15, completing the shaped contours predetermined thereby.

The fitting-device 29 has for each element, e.g. climbing iron, which is to be cemented into place, a housing 45 to 48 which is provided on the wall portion 32 and which has in detail a suitable supporting surface with centering provision in the region of an aperture 41 to 44, which serves for correctly positioned housing of an element, particularly a climbing iron, which is to be cemented into position and which has to be incorporated from outside through the aperture 41 to 44, all of which occurs prior to the shaping process.

The fit-in device 29 has furthermore for each aperture 41 to 44 and housing 45 to 48 a clamping device 88 to 91, all of which are combined via round guide rods 92 to produce a vertically upwardly and downwardly movable unit. The round guide rods 92 are adapted for vertical upwards and downwards displacement in divided plain bearings 93. Common to all clamping devices 88 to 91 is a single clamping drive 94 in the form of a hydraulic or pneumatic working cylinder which on the one hand engages the round guide rods 22 and on the other hand supports the core segment 30, in other words, like the clamping devices 88 to 91, it is likewise a part of the core segment 30.

For horizontal translatory movement of the core segment 30 in the direction of the arrow 33 and back, a drive device 35 is provided which in this case comprises two individual translatory drives in the form of hydraulic or pneumatic working cylinders 36, 37. Both extend substantially parallel with each other in the direction of the arrow 33. They lie on the same diametral plane which cuts the central axis 13 at a right-angle, doing so substantially at the center of the height of the wall portion 32, so that the translatory positioning movement into the release position and into the closed position does not allow substantially any moments to act on the core segment 30.

Together with the relevant housings 45 to 48 and the clamping devices 88 to 91 associated therewith and the climping drive 94 which is common to all, the complete core segment 30 is removably and exchangeably mounted as a complete element on the rest of the mould core 15. In this way, it is possible according to the type of the projecting elements, e.g. climbing irons, which have to be cemented in together with the shaping process, quickly to insert the embodiment of core segment 30 which is adapted to the circumstances and subsequently, when other elements, e.g. differently shaped climbing irons or the like, have to be incorporated in the same way directly during the shaping process, to withdraw the said core segment and exchange it for another suitably adapted core segment. Since as a rule differently designed climbing irons or other projecting elements have to be vibrated in simultaneously during the shaping process, there is no need to keep a stock of completely adapted and in each case different could cores, Instead, it is sufficient to keep in stock the smallest unit, namely the suitably adapted core segment, so that the costs are substantially reduced. For the rest, with the core segment 30 removed, the same mould core 15 can also be used when it is necessary to mould concrete parts which are not intended to comprise any projecting elements, e.g. climbing irons or the like, but which are for example continuously cylindrical. Either such concrete moulded parts can be produced with the same core segment 30, with bousings 45 to 48 completely closed by the clamping devices 88 to 91 or this core segment 30 is replaced by another core segment having a smooth and uninterruptedly extending wall portion 32.

Figure 5:
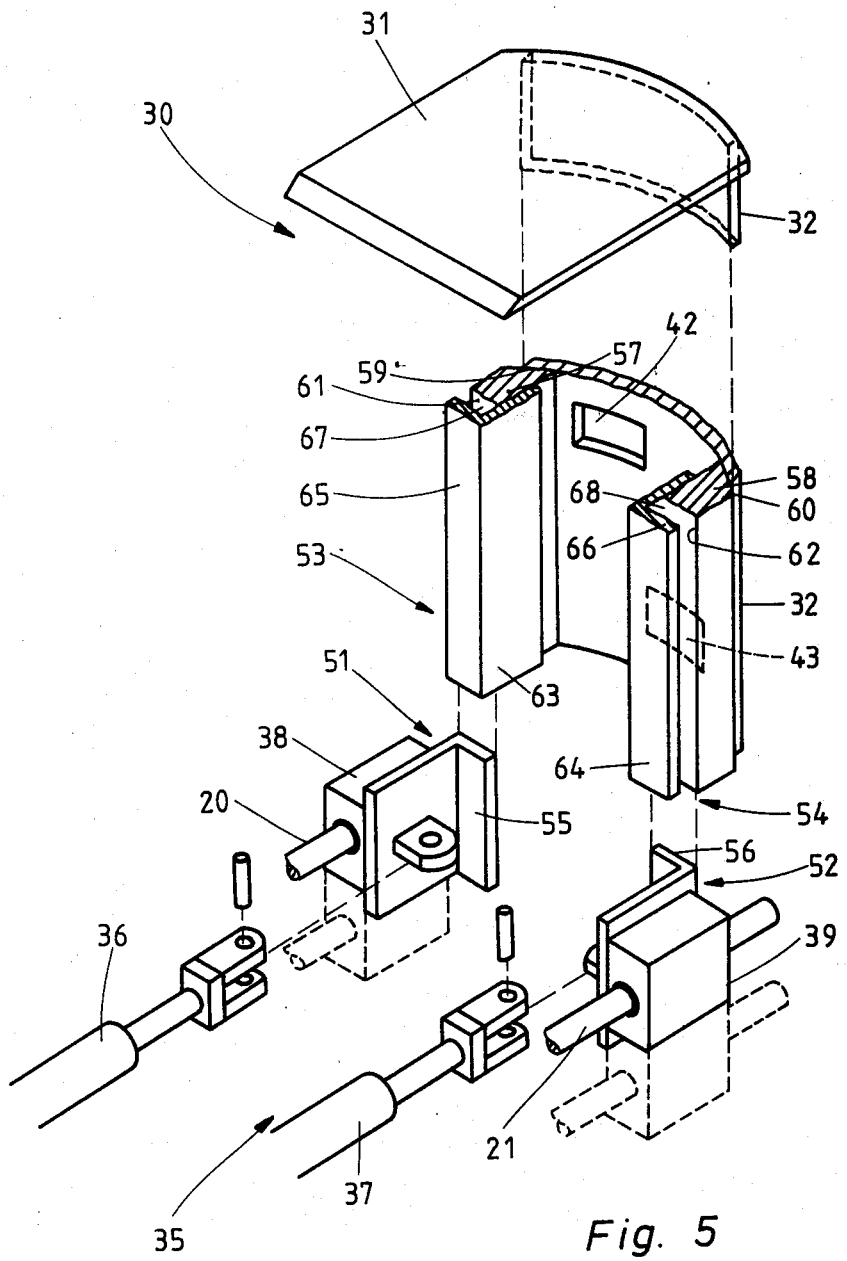
FIG. 5 is a diagrammatic perspective exploded view of component parts of the mould core.

The core segment 30 is adapted for separable connection to the drive device 35 in the form of two translatory drives 36, 37, so that when it is fitted, the core segment 30 is automatically coupled thereto and when it is withdrawn it is automatically uncoupled therefrom. The translatory drives 36, 37 are, for instance by their housing, supported at the end on a metal plate which at the same time serves to provide additional strengthening of the core wall 19. The piston rod of each translatory drive 36, 37 engages a positioning element 38, 39 which is guided for reciprocating movement parallel with the direction of translatory movement according to arrow 33 on a guide, being actuated by means of the translatory drive 36, 37. The guide has, for example a guide rod 20, 21 which directly traverses the positioning element 38, 39 or a guide bush inserted therein. FIG. 5 shows in broken lines that for each translatory drive 36, 37, two guide rods can be disposed to avoid any tilting movements.

The core segment 30 is designed to be inserted from above into the rest of the mould core 15 and to be withdrawn therefrom in the opposite direction in a direction at least substantially parallel with the central axis 13 of the mould core 15. During insertion, the wall portion 32 of the core segment 30 is adapted to be automatically coupled to the position elements 38, 39 and the translatory drives 36, 37 which are actuated by them, establishing a form-locking connection which upon actuation of the translatory drives 36, 37 in the direction of the arrow 33 and in the opposite direction thereto permits a transmission of forces to the wall portion 32.

The wall portion 32 on the one hand and the rest of the mould core 15 on the other hand have in the region of the mutually adjacent side edges extending substantially parallel with the central axis 13 of the mould core 15 have extending on both sides of the cut-out 34 guide members 51, 52 and, co-operating with these, guides 53, 54 which upon insertion of the core segment 30, automatically enter into guiding engagement with one another.

In the case of the example of embodiment illustrated, the guide members 51, 52 each consist of strips 55, 56 orientated substantially parallel with the central axis 13 and rigidly connected to the positioning element 38, 39. The thus constructed guide members 51, 52 are disposed on the rest of the mould core 15 via positioning elements 38, 39 and the translatory drives 36, 37 which actuate the latter.

The guides 53, 54 on the other hand are part of the wall portion 32 of the core segment 30. It will be equally well understood that the situation may also be kinematically reversed, In the case of the embodiment shown, the guides 53, 54 are formed as follows on the two lateral edges of the wall portion 32. On each lateral edge and fixed thereto, the wall portion 32 carries a strip 57, 58. Each strip 57, 58 at least partially projects laterally beyond the marginal edge of the wall portion 32 in the direction of the adjacent edge of the cut-out 34 and carries in this overlapping zone a bearing and sealing face 59, 60 which extends virtually as a continuation of the inner surface of the wall portion 32. At a right-angle thereto extends a surface 61, 62. In the inserted condition of the core segment 30 according to FIGS. 1 to 3, the bearing and sealing faces 59, 60 rest on the edges of the remaining part of the mould core 15, sealing the gap around the adjacent lateral edge, in fact around the core wall 19 on both sides of the cut-out 34, the wall portion 32 being pressed firmly and permanently through the translatory drives 36, 37 in the opposite direction to the arrow 33, so that despite the negligible gap in the marginal zone between the wall portion 32 and the cut-out 34, the bearing and sealing faces 59, 60 prevent the penetration of cement, particularly cement mortar. At the same time, a rigid connection is established between the core segment 30 on the one hand and the rest of the mould core 15 on the other, so that satisfactory transmission of the vibrations generated by the central vibrator for vibrating the concrete is guaranteed.

The strip 57, 58 extending along both edges of the wall portion 32 are at the same time constructed as reinforcing strips which additionally strengthen the wall portion 32, With its face 61, 62, each strip 57, 58 forms a part of the guide provided for each lateral edge of the wall portion 32, Fixed on each strip 57, 58 is an angle element 63, 64 having one arm which in the embodiment illustrated is exactly as long as the strip 57, 58 and exactly as long as the wall portion 32. In another embodiment, not shown, instead of a continuous angled element, a plurality of successive individual angled pieces are provided. The other arm 65, 66 of each angled element 63, 64 extends at a distance from the face 61, 62 of the strip 57, 58 forming in between a guide groove 67, 68. The width of the guide groove 67, 68 is somewhat greater than the cross-sectional thickness of the strip 55, 56 so that trouble-free insertion of the core segment 30 is possible from above, and also withdrawal in the opposite direction.

In the case of another embodiment, not shown, the guide members 51, 52 are formed by rods, bars or similar linear parts which for each lateral edge of the wall portion 32 are provided on the remainder of the mould core 15. In a corresponding correlation the guides 53, 54 are then constructed as elements comprising bushes, lugs or like guides with apertures, or also as rails, bars or other elements containing slots and which are fixed on each lateral edge of the wall portion 32.

In the case of the illustrated embodiment, by reason of the amalgamation of positioning element 38, 39 with guide member 51, 52, a particularly simple embodiment is achieved. Upon insertion of the core segment 30 from above, each strip 55, 56 enters from below into the marginal guide slot 67, 68 on the wall portion 32, said guide slot being open at least at its lower end. Afterwards, the core segment 30 is adapted for movement by means of the two translatory drives 36, 67 from the position in which insertion takes place, for example from the release position, into the closed position by actuation in the opposite direction to the arrow 33, and back into the released position, in the direction of the arrow 33. The closed position is reached when the bearing and sealing surfaces 59, 60 of the strip 57, 58 come to bear laterally of the cut-out 34 from within against the edge of the rest of the core wall 19. In this closed position, the core segment 30 is then pressed firmly and in sealing-tight fashion in the manner described.

Not further shown but associated with the wall portion 32 of the core segment 30 and locking this mechanically in the pressure-applied closed position is a locking device which upon reaching thc closed position and the described pressure-applying position, drops in for example automatically or moves into the locked position by actuation of its own special drive. This locking arrangement has, for example, one locking member per lateral edge of the wall part 32, the locking member consisting for example of an elbow lever or other per se known element.

Although there is no fixed connection and therefore no exact parallel guidance between the core segment 30 in the inserted position (FIGS. 1 to 3) and the positioning elements 38, 39 driven by the translatory drives 36, 37, it is nevertheless possible to achieve parallel guidance of the core segment 30 upon actuation of the translatory drives 36, 37 in opposition to and in the direction of the arrow 33. Both working cylinders 36, 37 are constructed as double-acting working cylinders, to which the pressurized working medium is fed via the line 69 for positioning movement in the closure direction, in opposition to the arrow 33, while for positioning movement in the opposite direction, the direction of the arrow 33, the pressurized working medium is fed through the line 72. The working medium carried, for example, through the line 69 does not pass directly into the working cylinder 36, 37. Instead, the flow of working medium is first sub-divided by a flow divider **69*a* into two equal individual flows which then through associated lines 70, 71 lead to the individual working cylinders 36, 37. In the opposite direction, the working medium is fed through the line 72 and divided over lines 73, 74. The flow divider 69*a* ensures that the two reverse flows from the working cylinders 36, 37 in the lines 70, 71 are of equal magnitude and are combined in the line 59. The applied force generated by the two working cylinders 36, 37 in the direction opposite to the arrow 33 is greater than the pressure of the concrete in the mould space which acts on the wall portion 32 of the core segment 30 during the shaping process, so that in other words the wall portion 32 becomes more solid, being the part of the entire mould core 15 which is rigidly connected to the rest of the mould core 15**.

Figure 6:
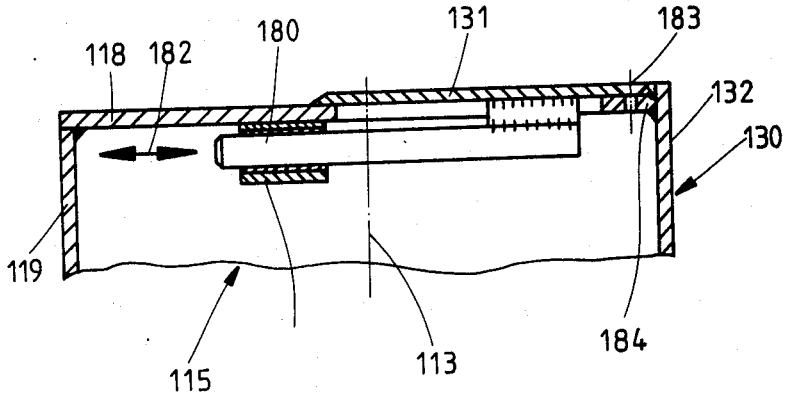
FIG. 6 is a diagrammatic section substantially corresponding to that in FIG. 2 but of the upper part of a mould core according to one example of embodiment.

In the case of the second embodiment shown in FIG. 6, for those parts which correspond to the first embodiment, the reference numerals used are raised by 100 so that reference is made to the first embodiment in order to avoid repetitions.

In the case of the second embodiment shown in FIG. 6, only the upper part of the mould core 115 is shown. Otherwise than in the case of the first embodiment, the cover portion 131 is not a part which is moved jointly with the core segment 130, Instead, the cover portion 131 is on the underside rigidly connected to a guide member, for example in the form of a guide rod 180 which extends substantially at a right-angle to the central axis 113 and thereby substantially horizontally, being guided for reciprocating displacement in a horizontal direction as indicated by the arrow 182. The guide bush 181 is fixed on the rest of the cover 118 which is rigidly connected to the rest of the core wall 119. The cover portion 131 is in the region of the upper end of the wall portion 132 of the core segment 130 separably connected thereto via countersunk screws 183 which are screwed into a retaining ring 184 on the inside of the wall portion 132. Prior to withdrawal of the core segment 130, for example in order to change it, it is firstly necessary to remove the countersunk screws 183 and detach the cover portion 131 from the wall portion 132 and to displace it leftwardly in the direction of the arrow 182 at least sufficiently far that afterwards the core segment 130 consisting of the wall portion 132 and the other parts can be withdrawn upwardly. Upon insertion of a new core segment 130, the procedure is reversed. For the rest, the cover portion 131 remains rigidly connected to the wall portion 132, particularly when the form work removal operation is involved, the core segment 130 being moved leftwardly in a horizontal direction in FIG. 6 into the release position, afterwards being returned to the closed position. Advantageous thereby is the fact that by reason of the guide rod 180 and the guide bush 181, additional parallel guidance is possible during this movement of the core segment 130 from the release position into the closed position and back.

Figures 7, 8:
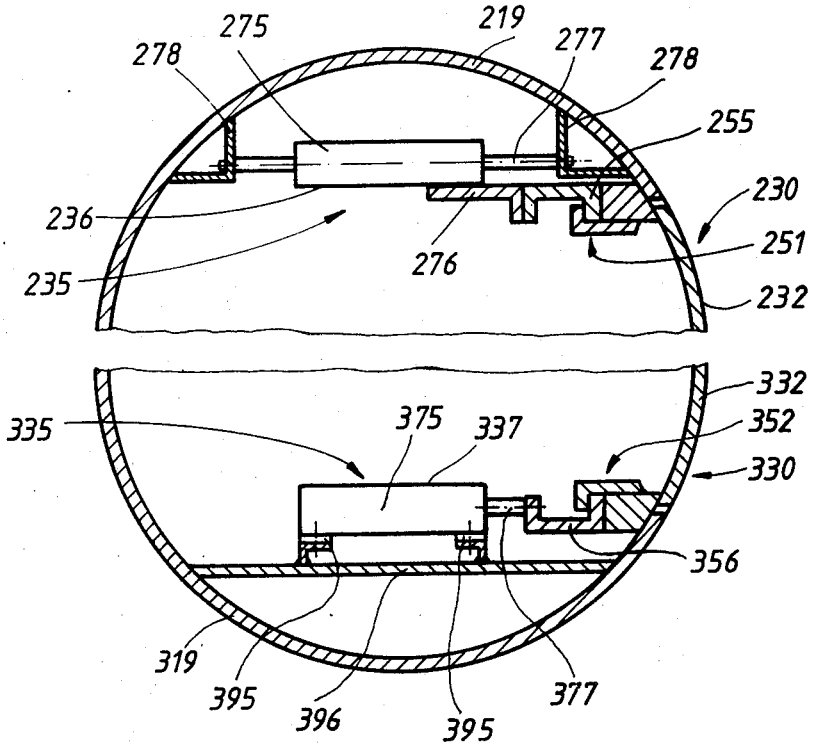
FIGS. 7 and 8 in each case show a diagrammatic section substantially corresponding to that in FIG. 3, through a mould core half according to a third and fourth embodiment respectively.

In the case of the third and fourth embodiments in FIGS. 7 and 8 respectively, for those parts which correspond to parts in the first embodiment, reference numerals are used which are raised by 200 and 300 respectively so that reference is thereby made to the description of the first embodiment.

In the case of the third embodiment shown in FIG. 7, the guide member 251 is disposed rigidly on the moving part, namely the cylinder barrel 275 of the translatory drive 236. The element, for example a U-shaped profile, which carries the strip 255, is screwed onto a retaining member 276 which is welded onto the cylinder barrel 275. The translatory drive 236 is double acting. Its piston rod 277 is continuous in construction and both ends are secured to angles 278 which are, for example, welded on core walls 219. In this way, the core segment 230 is the before fixed on the cylinder barrel 275 and through this it is guided in reciprocating fashion on the piston rod 277. Guidance is very accurate since the cylinder barrel 275 has guides at both end zones with a relatively large guide portion. Also the flexion loading of the piston rod 277 is very well accommodated by the bilateral mounting thereof. The piston disposed in the middle of the piston rod 277 has on left and right equal-sized piston faces so that for the movements in both directions, for the same pressure, equal forces and speeds result. This direct guidance leads to complete freedom from servicing. Wear and tear, too, is very small since the piston rod 277 is hard chromed.

In the case of the fourth embodiment shown in FIG. 8, the situation is reversed. Here, the translatory drive 337 consists of a likewise double-acting working cylinder but it is of pedestal construction and has a piston rod 377 projecting at one end. The translatory drive 337 has base parts 395 screwed onto a fixing plate 396. In this way, the cylinder barrel 375 is a fixed part of the mould core while the piston rod 377 is displaced in relation thereto. Directly mounted on the end of the piston rod 377 is the guide member 352, in other words the strip 356 which is part, for example, of a U-shaped profile. To achieve a high flexural strength, the cross-section of the piston rod 377 is more heavily dimensioned.

Figure 9:
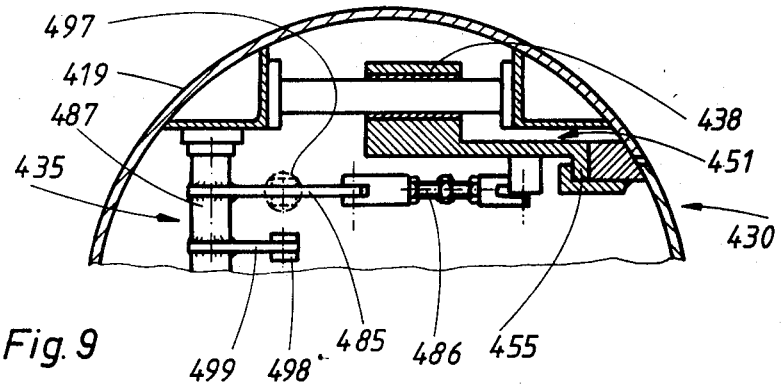
FIG. 9 is a diagrammatic cross-section through the mould core, substantially corresponding to that in FIG. 3 but in respect of a fifth embodiment.
Figure 10:
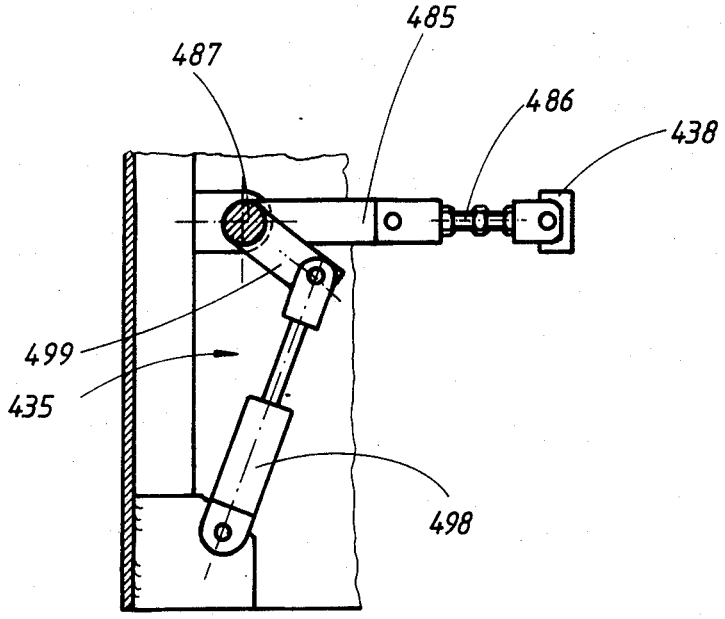
FIG. 10 is a diagrammatic partly sectional side view of the drive device in FIG. 9.

In the case of the fifth embodiment according to FIGS. 9 and 10, the drive means 435 has for each of the two guide members 451 in each case at least one pivot lever 485, the right-hand end of which is connected for pivoting movement to a push rod 486 which is in turn articulatingly connected to the positioning element 438 carrying the strips 455, for the translatory movement of the said positioning element 438. The length-of the push rod 486 is variable by means of an adjusting spindle with a left-hand thread and right-hand thread. It works on the relevant guide member 451. The (in FIGS. 9 and 10) left-hand end of the pivot lever 485 is rotationally rigidly connected to a shaft 487 which is pivotally mounted on the core wall 419. Together with the push rod 486, the pivot lever 485 forms a kind of elbow lever, the functioning length of these two parts being in the region of the push rod 486 so adjusted that in the shaping position of the core segment 430 the pivot lever 485 with the push rod 486 assumes a dead center position in which via both elements, the necessary pressure of the core segment 430 on the core wall 419 is assured. This has the advantage that during vibration the vibrations are satisfactorily transmitted to the core segment 430 and forcing of the core segment 430 back under the pressure of the concrete is impossible; nor does the drive device 435 have to apply any correspondingly great counter-forces.

By means of this arrangement, parallel guidance of the core segment 430 is possible even though the same arrangement is selected for the other guide member which is not shown, the pivot lever thereof being likewise connected in rotationally rigid fashion to the shaft 487.

For pivoting actuation of the relevant pivot lever 485 with push rod 486, the drive device 435 can for each of the two pivot levers 485 have its own translatory drive engaging directly thereon, being indicated in FIG. 9 diagrammatically as 497 and articulatingly engaging substantially the center of the pivot lever 485 for the pivoting movement thereof. Instead of this, the drive device 435 may also have, common to the two pivot levers 485, a translatory drive in the form of a working cylinder 498 (FIG. 10), which operates on one drive lever 499 which is rotationally rigidly connected to the shaft 487 and on which the working cylinder 498 engages at a distance from the shaft 487 for pivoting actuation of the shaft and thus of the two pivot levers 485. The drive lever 499 expediently fits approximately centrally on the shaft 487 so that any torsion in the shaft 487 cannot cause any unequal forces to act on the two pivot levers 485, While the invention has been illustrated and described as embodied in a moulding apparatus for shaping concrete parts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A moulding apparatus for shaping concrete parts provided with a plurality of projecting elements to be cemented from inside of the concrete part into the concrete part, said moulding apparatus comprising:

a mould core having a shaped contour, a central axis, a core wall made of a plurality of wall portions, a top cover and a fitting-in device so that during shaped, the projecting elements can be fitted and cemented into the concrete part to be formed, said fitting-in device having at least one core segment forming at least one wall portion of said core wall;

a drive device for moving said core segment relative to the remaining wall portions of said mould core out of said shaped contour into a release position which permits a concrete part to be removed, and back into a closed position in which said core segment fits into said remaining wall portions of said mould core, completing said contour, said one wall portion and said remaining wall portions having mutually adjacent lateral edges whcih are substantially parallel to said central axis of said mould core;

guide members and guides located on and extending from said one wall portion and said remaining wall portions in the region of said mutually adjacent lateral edges, said guide members and guides automatically entering into a guiding engagement with one another upon insertion of said core segment, said drive device actuating two spaced-apart guide members to reciprocate in a translatory manner, and upon insertion of said core segment being automatically coupled form-lockingly in a translatory manner with one wall portion of said core segment; and a plurality of housings each having an associated clamping device and an associated clamping drive, one said housing being provided for each projecting element to the cemented in, said core segment together with said housings, said clamping devices and said clamping drive being detachably and exchangeably supported on said remaining wall portions of said mould core.

2. A moulding apparatus as defined in claim 1, wherein said core wall is cylindrical.

3. A moulding apparatus as defined in claim 1, wherein said core segment is formed so that it can be detachably coupled to and uncoupled from said drive device.

4. A moulding apparatus as defined in claim 1, wherein said core segment is disposed so as to be pushable at least substantially parallel to said central axis of said mould core in a downward direction into said remaining wall portions of said mould core wall and in an upward direction to be withdrawn therefrom, 5. A moulding apparatus as defined in claim 1, wherein said guide members provided for each lateral edge of said one wall portion of said core segment consist of one of the group consisting of rods, bars and rails.

6. A moulding apparatus as defined in claim 1, wherein said guides consist of elements having apertures provided for each said lateral edge of said one wall portion.

7. A moulding apparatus as defined in claim 6, wherein said elements are bushes.

8. A moulding apparatus as defined in claim 1, wherein said guides are rails provided for each said lateral edge of said one wall portion, 9. A moulding apparatus as defined in claim 1, wherein said guides are bars provided for each said lateral edge of said one wall portion.

10. A moulding apparatus as defined in claim 1, wherein said guides are grooves provided for each said lateral edge of said one wall portion.

11. A moulding apparatus as defined in claim 1, wherein said guide members are disposed on said remaining wall portions of said mould core, and said guides are disposed on said one wall portion of said core segment.

12. A moulding apparatus as defined in claim 1, wherein said one wall portion has an inner face; and further comprising rails fixed on each said lateral edge of said one wall portion, each said rail having a laterally projecting bearing and sealing surface extending as a continuation of said inner face, so that when said core segment is inserted said lateral edges of said one wall portion bear against said lateral edges of said remaining wall portion and seal any gaps, 13. A moulding apparatus as defined in claim 12, wherein said lateral edges of said one wall portion are pressed against said lateral edges of said remaining wall portion.

14. A moulding apparatus as defined in claim 12, wherein said rails are constructed as strips for reinforcing said one wall portion.

15. A moulding apparatus as defined in claim 12, wherein each said rail is formed as a part of said guide of said wall portion which is provided on each said lateral edge.

16. A moulding apparatus as defined in claim 12, wherein each said rail has a length and a surface; and further comprising an angle element fixed on each said rail and extending over said rail length, said angle element having one arm which extends at a distance from said rail surface so as to form a guide slot.

17. A moulding apparatus as defined in claim 16, wherein said angle element is subdivided into a plurality of consecutively spaced portions along said rail length.

18. A moulding apparatus as defined in claim 1, wherein said one wall portion has two marginal guide slots that are at least open-bottomed; and further comprising a plurality of rails, one rail being mounted on each said guide member and extending substantially parallel with said central axis, so that upon insertion of said core segment said rails move upward into said marginal, open-bottomed guide slots.

19. A moulding apparatus as defined in claim 12, wherein said core segment is adapted to be moved by said drive device from said closed position into said release position and back, in said closed position said core segment being adapted to have said bearing and sealing surfaces of said lateral rails pressed in a rigid and sealing-tight fashion against an adjacent wall zone of said remaining wall portions of said mould core.

20. A moulding apparatus as defined in claim 1; and further comprising at least one pivot lever connected to said drive device for each said guide member; and a variable-length push rod articulated on said pivot lever, said pivot lever operating as an associated guide member through said variable-length push rod.

21. A moulding apparatus as defined in claim 20; and further comprising a shaft mounted on said core wall, said pivot levers being connected to said shaft for joint rotation therewith.

22. A moulding apparatus as defined in claim 21, wherein said drive device includes a translatory drive for each pivot lever said translatory drive engaged directly on said pivot lever to pivot said pivot lever with said shaft.

23. A moulding apparatus as defined in claim 22, wherein said translatory drive is a pneumatic working cylinder.

24. A moulding apparatus as defined in claim 22, wherein said translatory drive is a hydraulic working cylinder.

25. A moulding apparatus as defined in claim 21, wherein said drive device includes a translatory drive common to two of said pivot levers; and further comprising a drive lever connected to said shaft for joint rotation therewith and articulated at a distance from said shaft to said translatory drive so that said translatory drive operates on said drive lever.

26. A moulding apparatus as defined in claim 1; and further comprising a current divider which subdivides a flow of said working medium into two equal parts so that said working medium is supplied under pressure to both said working cylinders for actuation in at least one translatory manner.

27. A moulding apparatus as defined in claim 1, wherein the concrete acts on said one wall portion of said core segment with a pressure during the shaping process, and said two working cylinders being formed so as to generate a pressure force greater than said concrete pressure.

28. A moulding apparatus as defined in claim 1; and further comprising a guide on said mould core, each said guide member which is supported on said remaining wall portion of said mould core being part of an associated positioning element which is guided for translatory movement on said mould core guide for positioning said one wall portion.

29. A moulding apparatus as defined in claim 1, and further comprising a locking arrangement which mechanically locks said one wall portion of said core segment in said closed position.

30. A moulding apparatus as defined in claim 1, wherein said one wall portion has a top and a cover portion fixed on said top, and said top cover of said mould core has a cut-out which is overlapped by said cover portion of said one wall portion in a sealing-tight manner.

31. A moulding apparatus as defined in claim 30, wherein said cover portion is welded on said one wall portion.

32. A moulding apparatus as defined in claim 30, wherein said cover portion is an integral component of said core segment.

33. A moulding apparatus as defined in claim 30; and further comprising a cover guide on said remaining wall portions of said mould core, said cover guide extending at least substantially at a right angle to said central axis of said mould core, said cover portion being guided for reciprocating displacement along said cover guide and supported thereon, and said cover portion being detachably connected to said one wall portion.

34. A moulding apparatus as defined in claim 1, wherein said top cover is fixed on said remaining wall portion of said mould core.

35. A moulding apparatus as defined in claim 34, wherein said top cover is welded to said remaining wall portion.

36. A moulding apparatus as defined in claim 1, wherein said top cover is an integral component of said remaining wall portion of said mould core.

37. A moulding apparatus for shaping concrete parts provided with a plurality of projecting elements to be cemented from inside of the concrete part into the concrete part, said moulding apparatus comprising:

a mould core having a shaped contour, a central axis, a core wall made of a plurality of wall portions, a top cover and a fitting-in device so that during shaping, the projecting elements can be fitted and cemented into the concrete part to be formed, said fitting-in device having at least one core segment forming at least one wall portion of said core wall;

a drive device for moving said core segment relative to the remaining wall portions of said mould core out of said shaped contour into a release position which permits a concrete part to be removed, and back into a closed position in which said core segment fits into said remaining wall portions of said mould core, completing said contour, said one wall portion and said remaining wall portions having mutually adjacent lateral edges which are substantially parallel to said central axis of said mould core;

guide members and guides located on and extending from said one wall portion and said remaining wall portions in the region of said mutually adjacent lateral edges, said guide members and guides automatically entering into a guiding engagement with one another upon insertion of said core segment, said drive device including two translatory drives supported on said remaining wall portion of said mould core and disposed at a distance from and along side one another, each of said translatory drives having a moving part and another part, each said guide member being rigidly attached to said moving part of a respective translatory drive and being guided along with said moving part on said another part of said respective translatory drive, said another part being rigidly mounted on said mould core, said drive device thus actuating said guide members through said translatory drives to selectively couple with said core segment to secure the mould core together; and a plurality of housings each having an associated clamping device and an associated clamping device, one said housing being provided for each projecting element to be cemented in, said core segment together with said housing, said clamping devices and said clamping drive being detachably and exchangeably supported on said remaining wall portions of said mould core.

38. A moulding apparatus for shaping concrete parts provided with a plurality of projecting elements to be cemented from inside of the concrete part into the concrete part, said moulding apparatus comprising:

a mould core having a shaped contour, a central axis, a core wall made of a plurality of wall portions, a top cover and a fitting-in device so that during shaping, the projecting elements can be fitted and cemented into the concrete part to be formed, said fitting-in device having at least one core segment forming at least one wall portion of said core wall;

a drive device for moving said core segment relative to the remaining wall portions of said mould core out of said shaped contour into a released position which permits a concrete part to be removed, and back into a closed position in which said core segment fits into said remaining wall portions of said mould core, completing said contour, said one wall portion and said remaining wall portions having mutually adjacent lateral edges which are substantially parallel to said central axis of said mould core;

guide members and guides located on and extending from said one wall portion and said remaining wall portions in the region of said mutually adjacent lateral edges, said guide members and guides automatically entering into a guiding engagement with one another upon insertion of said core segment, said drive device including two translatory drives supported on said remaining wall portion of said mould core and disposed at a distance from alongside one another, each of said translatory drives having a moving part and another part, each said guide member being rigidly attached to said moving part of a respective translatory drive and being guided along with said moving part on said another part of said respective translatory drive, said another part being rigidly mounted on said mould core, each translatory drive being a working cylinder having a continuous piston rod and a moving cylinder housing, said piston rod being rigidly mounted on said mold core, and said moving cylinder housing carrying a rigidly attached associated guide member, said drive device thus actuating said guide members through said translatory drive to selectively couple with said core segment to secure the mould core together; and a plurality of housings each having an associated clamping device and an associated clamping drive, one said housing being provided for each projecting element to be cemented in, said core segment together with said housings, said clamping devices and said clamping drive being detachably and exchangeably supported on said remaining wall portions of said mould core.

* * * * *